US005601452A

United States Patent [19]

Ruffa

[11] Patent Number: 5,601,452

[45] Date of Patent: Feb. 11, 1997

[54] NON-ARCING CLAMP FOR AUTOMOTIVE BATTERY JUMPER CABLES

[75] Inventor: Anthony A. Ruffa, Niantic, Conn.

[73] Assignee: The United States of America as represented by the Secretary of the Navy, Washington, D.C.

[21] Appl. No.: 538,266

[22] Filed: Oct. 3, 1995

[51] Int. Cl.[6] ..... H01R 11/22

[52] U.S. Cl. ..... 439/504; 439/506

[58] Field of Search ..... 439/504, 506, 439/759, 822; 320/2, 25, 26

[56] References Cited

U.S. PATENT DOCUMENTS

| | | | |
|---|---|---|---|
| 4,163,134 | 7/1979 | Budrose | 439/504 |
| 4,166,241 | 8/1979 | Grant | 320/25 |
| 4,769,586 | 9/1988 | Kasmierowicz | 320/26 |
| 4,871,957 | 10/1989 | Taranto et al. | 320/26 |
| 4,938,712 | 7/1990 | Black | 320/25 |

*Primary Examiner*—Neil Abrams
*Attorney, Agent, or Firm*—Michael J. McGowan; Prithvi C. Lall; Michael F. Oglo

[57] ABSTRACT

An automotive battery jumper cable includes an electrically conductive cable which is terminated at each end by a terminal clamp. Each of the terminal clamps includes a pair of gripping members each having a jaw end and a handle end. The gripping members are pivotably connected to each other about an axis between the jaw ends and the handle ends. A torsion spring is mounted on the gripping members for normally urging the jaw ends toward each other. Each of the jaw ends of the gripping members is provided with a copper jaw member for engaging and grasping the battery terminal. One of the jaws on each clamp is not electrically connected to the cable. However, the other jaw of each clamp is electrically connected to the respective end of the cable via an encapsulated pressure switch. The pressure switch is physically positioned between the copper jaw and the jaw end of the gripping member such that spring pressure provided by the torsion spring is operative for closing the pressure switch when the clamp is mounted on a battery terminal. An in-line fuse can be mounted in the cable to prevent short circuits of the batteries.

4 Claims, 2 Drawing Sheets

NON-ARCING CLAMP FOR AUTOMOTIVE BATTERY JUMPER CABLES

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The instant invention relates to automotive battery jumper cables for connecting a weak battery to a stronger battery, and more particularly to a clamp for a jumper cable which reduces the chance of an electrical arc when making the connection.

(2) Description of the Prior Art

Automotive batteries produce both hydrogen and oxygen gas as a result of being charged and discharged. These gases can potentially be ignited, causing an explosion. One potential cause of ignition can be sparks due to electrical arcs that can occur when connecting jumper cables to the battery terminals. Essentially, jumper cables comprise two electrically conductive cables with spring clamps at each end of the cables to releasably engage the battery terminals. Typically, an arc, or sparking occurs directly at the battery terminal when connecting the last, i.e., fourth, clamp to the respective battery. To reduce the chance of such sparks igniting the gases around the battery, jumper cables having remote switching devices located well away from the battery terminals have heretofore been known in the art. In this regard, the U.S. Pat. No. to Asbury, 4,662,696 is representative of the prior art devices. The patent to Asbury discloses a battery jumper cable having a safety switch located intermediate the clamp ends of the cable. The switch is normally biased to the open position and includes a handle, which when depressed makes electrical contact between the leads of the battery cable.

The instant invention provides an automotive battery jumper cable including an improved clamp which eliminates the need for a manually activated remote safety switch. The instant jumper cable assembly comprises an electrically conductive cable which is terminated at each end by the improved clamp. Each of the clamps comprises a pair of gripping members each having a jaw end and a handle end. The gripping members are pivotably connected to each other about an axis between the jaw ends and the handle ends. A torsion spring is mounted on the gripping members for normally urging the jaw ends toward each other. Each of the jaw ends of the gripping member is provided with a copper jaw member for engaging and grasping the battery terminal. One of the jaws on each clamp is not connected to the cable. However, the other jaw of each clamp is electrically connected to the respective end of the cable via an encapsulated pressure switch. It is to be noted that only one of the four clamps needs to have the encapsulated pressure switch to prevent arcing. The pressure switch is physically positioned between the copper jaw and the jaw end of the gripping member such that spring pressure provided by the torsion spring is operative for closing the pressure switch when the clamp is mounted on a battery terminal. One contact of the switch is connected to the copper jaw and the other contact is connected to the cable. Both contacts are electrically insulated within the encapsulated switch. Since electrical connection is completed inside the encapsulated switch, any potential spark is insulated within the switch. An in-line fuse may also be positioned on the cable to provide short-circuit protection.

Accordingly, among the objects of the instant invention are: the provision of an improved clamp for an automotive battery jumper cable which reduces arcing in the vicinity of the battery terminal; the provision of a battery jumper cable assembly which is terminated at each end by the improved clamp of the invention; and the provision of a battery jumper cable assembly including the instant clamp members and further including an in-line fuse in the cable for preventing short circuits.

Other objects, features and advantages of the invention shall become apparent as the description thereof proceeds when considered in connection with the accompanying illustrative drawings.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

DESCRIPTION OF THE PREFERRED EMBODIMENT

Figure 1:
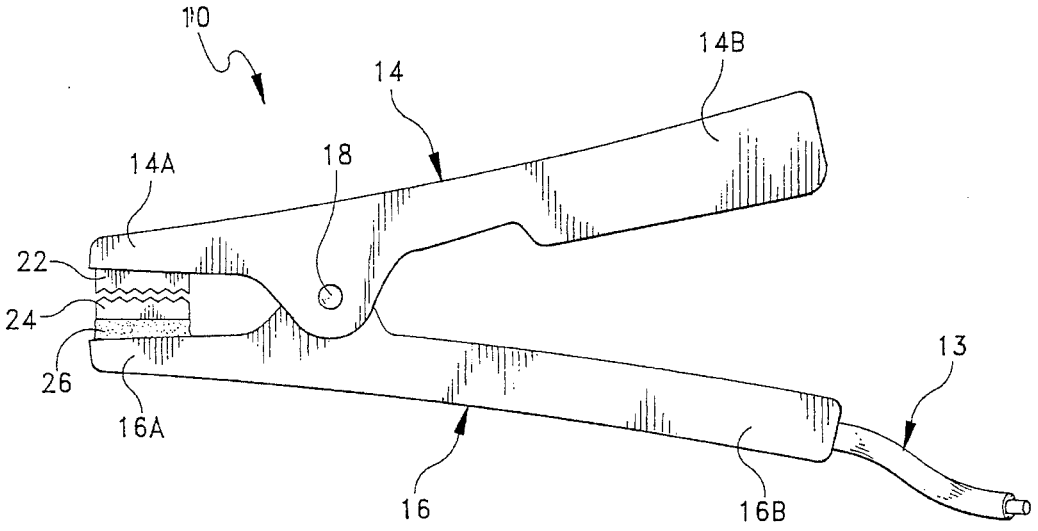
FIG. 1 is an elevational view of the improved non-arcing terminal clamp of the instant invention.
Figure 2:
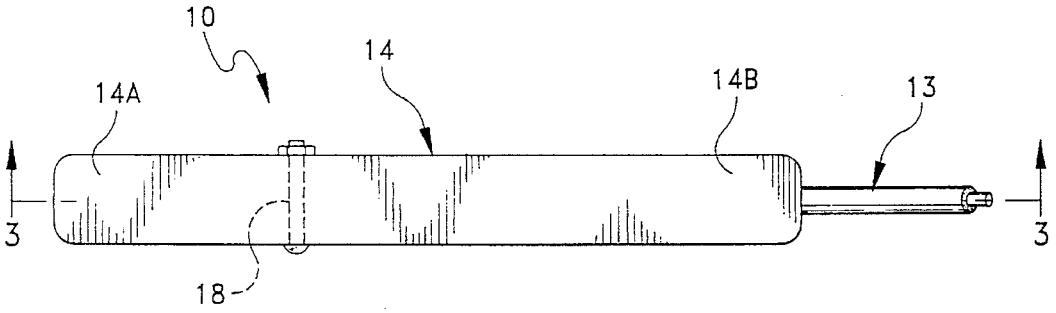
FIG. 2 is a top view thereof.
Figure 3:
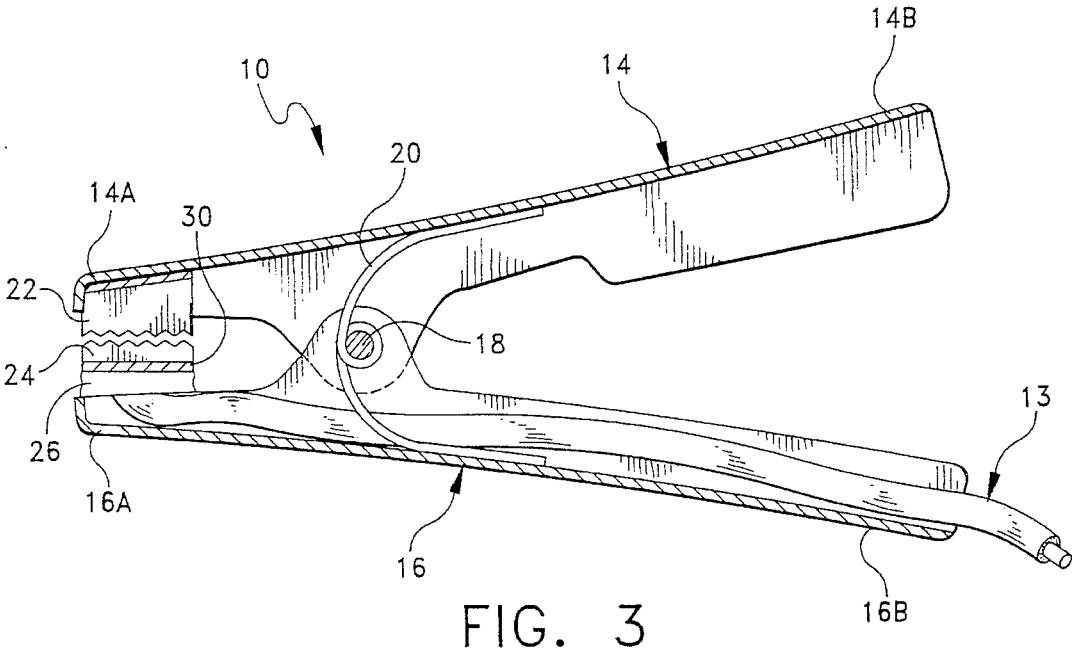
FIG. 3 is a cross-sectional view thereof taken along line 3—3 of FIG. 2.
Figure 4:
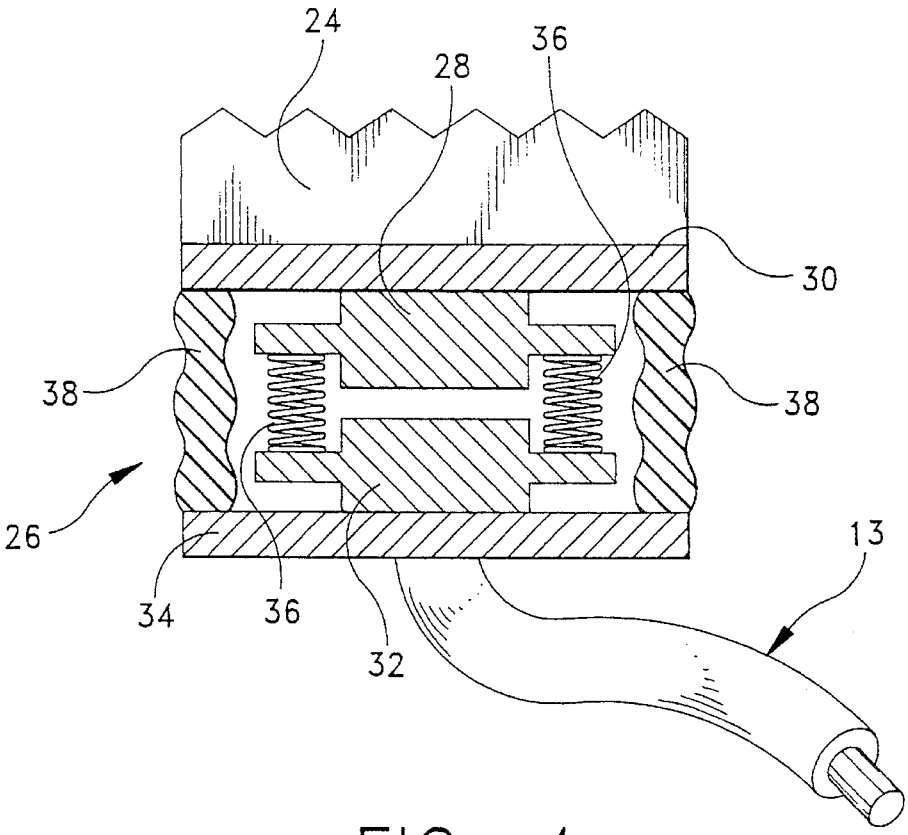
FIG. 4 is an enlarged cross-sectional view of the pressure switch.
Figure 5:
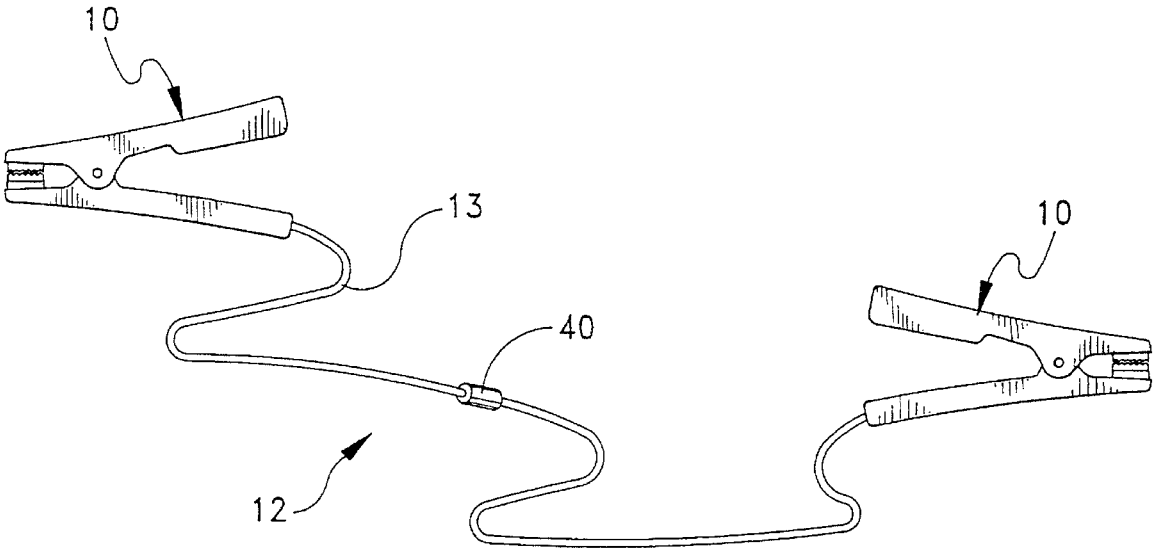
FIG. 5 is a perspective view of a cable assembly in accordance with the instant invention.

Referring now to the drawings, the non-arcing clamp of the instant invention is illustrated and generally indicated at 10 in FIGS. 1–5. As will be further described, the clamp 10 is utilized in a jumper cable assembly 12 (FIG. 5) wherein it is operative for reducing arcing, or sparking, when making a connection between two automotive batteries. The jumper cable assembly 12 comprises an insulated, electrically conductive cable 13 which is terminated at each end by one of the clamps 10. Each of the clamps 10 comprises a pair of gripping members generally indicated at 14, 16 respectively, each of the gripping members 14, 16 having a respective jaw end 14A, 16A, and a respective handle end 14B, 16B. The gripping members 14, 16 are pivotably connected to each other by a pivot pin 18 which forms a pivot axis positioned between the jaw ends 14A, 16A and the handle ends 14B, 16B. A torsion spring 20 is received around the pivot pin 18 such that it is operative for normally urging the jaw ends 14A, 16A toward each other. Each of the jaw ends 14A, 16A of the gripping members 14, 16 is provided with a copper jaw member 22, 24 respectively, for engaging and grasping a battery terminal (not shown). The jaw 22 is not electrically connected to the cable 13. However, the other jaw 24 is electrically connected to the respective end of the cable 13 through an encapsulated pressure switch, generally indicated at 26. The pressure switch 26 includes a first contact 28 which is electrically connected to a land portion 30 of the jaw member 24, and further includes a second contact 32 which is electrically connected to a copper pad 34 which in turn is electrically connected to the cable 13. The contacts 28 and 32 are biased to an open position (FIG. 4) by non-conductive spring members 36. It is to be noted that conductive spring members can also be used, but they must be insulated from the contacts. They can either be coated with a polymer or they can be insulated at the points of contact with the seats of the contacts. The entire switch 26 is encapsulated by a resilient insulating material 38, such as neoprene, to isolate the contacts 28, 32 from the surrounding environment. The pressure switch 26 is physically located between the copper jaw 24 and the jaw end 16A of the gripping member 16 such that spring pressure provided by the torsion spring 20 is operative for closing the pressure switch, i.e., moving contacts 28, 32 into electrical engagement, when the clamp 10 is mounted on a battery terminal.

It can thus be seen that the electrical connection between contacts 28, 32 is completed within the switch 26. Since the electrical connection is completed inside the encapsulated switch, any potential spark is insulated within the switch, away from the ambient environment, and thus the chance of ignition of hydrogen gas in the environment is reduced or eliminated.

The cable assembly 12 may further comprise an in-line resettable fuse, positioned in the cable 13 to prevent short circuit of the battery in the event of reversed polarity connections.

The instant invention thus provides an effective non-arcing clamp which significantly reduces, or prevents the chance of electrical arc when making an electrical connection between two batteries. The encapsulated pressure switch 26 and its mounting position on the jaw end of the gripping member allow automatic closure of the switch 26 when making the connection, while also isolating the connection point from the surrounding environment. For these reasons, the clamp of the instant invention is believed to represent a significant improvement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clamp for a jumper cable comprising:

a pair of gripping members, each having a jaw end and a handle end, said gripping members being pivotably connected to each other about an axis between the jaw ends and the handle ends;

spring means mounted on the gripping members for normally urging the jaw ends toward each other and the handle ends away from one another;

a first jaw member secured to the jaw end of one of said gripping members;

a second jaw member secured to the jaw end of the other of said gripping members; and a pressure switch positioned between said second jaw member and said gripping member such that spring pressure provided by said spring means is operative for closing said pressure switch when said clamp is mounted on a battery terminal, said pressure switch being encapsulated by a flexible insulating material, said pressure switch having a first contact in electrical communication with said second jaw member, and further having a second contact in electrical communication with an electrically conductive cable.

2. A jumper cable assembly comprising:

an electrically conductive cable having first and second ends;

a pair of first and second terminal clamps respectively connected to the first and second ends of said cable and each of said pair of first and second terminal clamps including a pair of first and second gripping members each having a jaw end and a handle end, said jaw end and said handle end of each of said pair of gripping members being pivotally connected to each other about an axis between the jaw and the handle ends;

a pair of first and second gripping members each having a jaw end and a handle end each of said first and second gripping members connected to said pair of gripping members being pivotably connected to each other about an axis between the jaw ends and the handle ends;

spring means mounted on said pair of gripping members for normally urging the jaw ends toward each other and the handle ends away from one another;

a first jaw member secured to the jaw end of the first of said pair of gripping members;

a second jaw member secured to the jaw end of the second of said pair of gripping members;

a pressure switch means positioned between said second jaw member and said gripping member such that spring pressure provided by said spring means is operative for closing said pressure switch means when said clamp is mounted on a battery terminal;

said pressure switch means being encapsulated by an insulating material, said pressure switch means having a first contact in electrical communication with said second jaw member; and said pressure switch means of said first terminal clamp having a second contact in electrical communication with said first end of said cable, said pressure switch means of said second terminal clamp having a second contact in electrical communication with said second end of said cable.

3. The jumper cable assembly of claim 2 further comprising an in-line fuse positioned between the ends of the cable.

4. The jumper cable assembly of claim 1, wherein only one of the four clamps includes the encapsulated pressure switch.

* * * * *